US009440774B2

(12) United States Patent
Schick

(10) Patent No.: US 9,440,774 B2
(45) Date of Patent: Sep. 13, 2016

(54) CLOSURE FOR PACKAGING

(71) Applicant: NESTEC S.A., Vevey (CH)

(72) Inventor: Werner Schick, Neuenkirchen (DE)

(73) Assignee: Nestec S.A., Vevey (CH)

( * ) Notice: Subject to any disclaimer, the term of this patent is extended or adjusted under 35 U.S.C. 154(b) by 0 days.

(21) Appl. No.: 14/379,329

(22) PCT Filed: Feb. 14, 2013

(86) PCT No.: PCT/EP2013/000445

§ 371 (c)(1),
(2) Date: Aug. 18, 2014

(87) PCT Pub. No.: WO2013/120617

PCT Pub. Date: Aug. 22, 2013

(65) Prior Publication Data

US 2015/0034645 A1 Feb. 5, 2015

(30) Foreign Application Priority Data

Feb. 17, 2012 (DE) ..... 10 2012 003 058

(51) Int. Cl.
*B65D 43/02* (2006.01)
*B65D 77/04* (2006.01)
(Continued)

(52) U.S. Cl.
CPC ..... *B65D 43/0235* (2013.01); *B65D 43/163* (2013.01); *B65D 43/169* (2013.01); *B65D 55/02* (2013.01); *B65D 55/024* (2013.01); *B65D 77/0493* (2013.01); *B65D 2101/0015* (2013.01); *B65D 2101/0023* (2013.01)

(58) Field of Classification Search
CPC B65D 43/0235; B65D 43/163; B65D 55/02; B65D 77/0493; B65D 43/169; B65D 55/024; B65D 2101/0015; B65D 2101/0023; B65D 43/16; B65D 43/02
USPC ..... 220/810, 836, 256.1, 257.2, 258.2, 220/259.1, 254.1, 254.3, 254, 256, 265, 220/270, 266; 215/253, 250, 237, 235
See application file for complete search history.

(56) References Cited

U.S. PATENT DOCUMENTS 4,883,193 A * 11/1989 Christensson ..... B65D 15/22 220/266
5,667,092 A 9/1997 Julius et al.
(Continued)

FOREIGN PATENT DOCUMENTS

DE 6919071 8/1969
EP 0312513 4/1989
(Continued)

OTHER PUBLICATIONS

International Search Report for International Application No. PCT/EP2013/00445 dated Aug. 8, 2013.
(Continued)

*Primary Examiner* — Robert J Hicks
*Assistant Examiner* — Kareen Thomas
(74) *Attorney, Agent, or Firm* — K&L Gates LLP

(57) ABSTRACT

The invention relates to a closure for an in particular cylindrical packaging (1) for foodstuffs, having an insert (3) that comprises a preferably central outlet opening (6) and one part (5) of which is intended to be fastened to the packaging (1), and a cover (4) connected in an articulated manner thereto for sealing the top of the outlet opening (6), which cover is connected to the insert (3) by a tamper-evident closure, wherein the tamper-evident closure has a tamper-evident element (9) connected to the cover (4) or the insert (3) via at least one target break point (27), which element is arranged to the side of an in particular circumferential edge (12, 13) of the closure in the covering situation and is thus arranged offset to the outlet opening (6), wherein the tamper-evident element (9) has at least one stop (39, 38) edge on each of opposite ends, between which the tamper-evident element (9) is held to a protrusion (10) of the cover (4) or the insert (3) after loosening the tamper-evident closure. The invention further relates to a packaging for foodstuffs.

20 Claims, 12 Drawing Sheets

Figure 1:
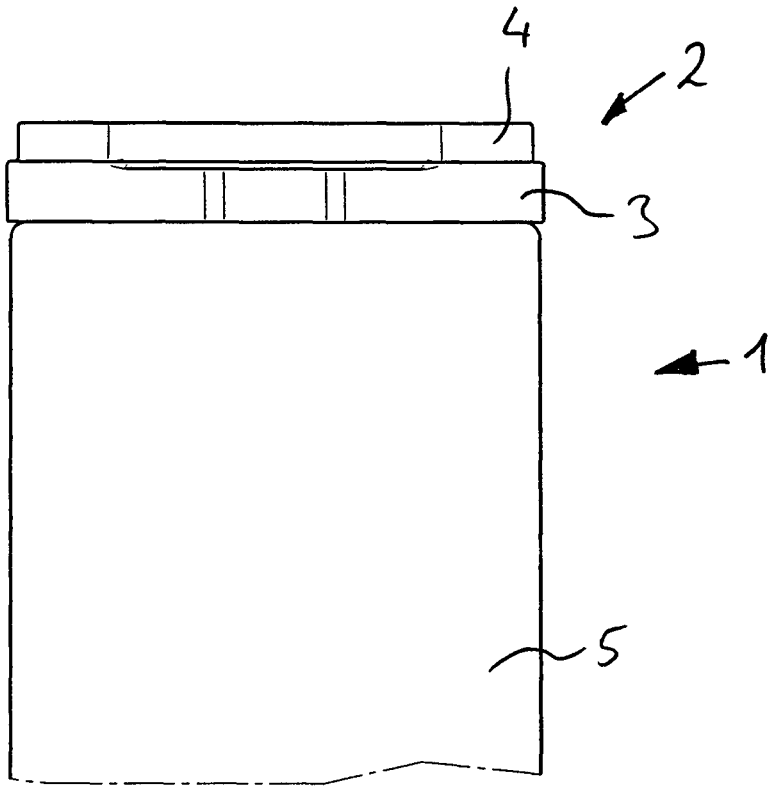

(51) Int. Cl.
*B65D 43/16* (2006.01)
*B65D 55/02* (2006.01)

(56) References Cited

U.S. PATENT DOCUMENTS

| | | | | |
|---|---|---|---|---|
| 5,685,444 | A * | 11/1997 | Valley | 215/253 |
| 2009/0230142 | A1* | 9/2009 | Sheahan | B65D 55/16 220/810 |
| 2011/0056982 | A1* | 3/2011 | Swanick | 222/83 |

FOREIGN PATENT DOCUMENTS

| | | |
|---|---|---|
| WO | WO9711004 | 3/1997 |
| WO | 2006020059 | 2/2006 |

OTHER PUBLICATIONS

International Written Opinion for International Application No. PCT/EP2013/00445 dated Aug. 8, 2013.

* cited by examiner

CLOSURE FOR PACKAGING

CROSS REFERENCE TO RELATED APPLICATIONS

The present application is a National Stage of International Application No. PCT/EP2013/000445, filed on Feb. 14, 2013, which claims priority to German Patent Application No. 102012003058.4, filed Feb. 17, 2012, the entire contents of which are being incorporated herein by reference.

The present invention relates to a closure for an in particular cylindrical packaging for foodstuffs, with an insert, which has a preferably central discharging opening and is to be secured on a part of the packaging, and with a lid, which is connected in an articulated manner to the insert, is provided for closing the discharging opening from the top and is or can be connected to the insert via a tamper-evident closure, the tamper-evident closure having a tamper-evident element which is connected to the lid or the insert via at least one predetermined break point and, in the lid-down situation, is arranged toward the side of an in particular circumferential edge of the closure and therefore offset with respect to the discharging opening.

A great many articles according to the preamble of claim 1 are known in the prior art.

For example, DE 20 2008 004 047 U1 describes a closure in which a tamper-evident element has to be torn off from the closure together with a tab. This closure is unsuitable for packaging of confectionery for children, since separate parts exist after the tamper-evident closure has been broken off from the closure.

The same also applies to the article according to DE 2155664. Furthermore, in the latter, and also in the above-described article according to the prior art, it is difficult or impossible to tell from above whether the tamper-evident seal has been damaged. Particularly in the case of closures for tubular packages with chocolate-containing confectionery items that are placed vertically alongside one another, it is not immediately apparent whether the tamper-evident seal is damaged.

DE 3213191 A1 describes a container with a tamper-evident lid in which, in a plan view, it is difficult or impossible to tell whether the tamper-evident seal is damaged.

EP 1233924 B1 likewise describes a closure with a tamper-evident seal in which, however, separate parts may result even after the tamper-evident seal has been damaged deliberately.

The object of the present invention is to design a closure of the aforementioned type that is better suited to the target group, i.e. children.

The object is achieved by an article as claimed in claims 1, 6 and 16. Advantageous refinements are set forth in the description below and in the dependent claims referring back to the aforementioned claims.

According to the invention, the tamper-evident element, preferably designed as a tamper-evident pin, has in each case at least one abutment at opposite ends, between which abutments the tamper-evident element is held on a projection of the lid or of the insert after the release of the tamper-evident closure and the associated breaking at the predetermined break point. The closure according to the invention does not have separate parts, even when the tamper-evident seal is damaged. Accordingly, no such separate part can be swallowed by a child.

The abutment can be formed by edges, surfaces or support points of the tamper-evident pin in the respective end areas thereof. It is important that the tamper-evident element cannot slip in any direction on the projection of the lid or insert such that it is separated from the closure. In addition to or as an alternative to one projection, the tamper-evident element can also be held on two or more projections and/or via a flexible web that is not torn off. Such a projection is formed, for example, by the edge of a recess through which the tamper-evident element is brought to its position indicating originality.

The predetermined break point is advantageously integrated into the lid in such a way that it can be seen from above in a plan view. Accordingly, particularly in the case of tray-like packaging displays, damage to the tamper-evident seal can easily be discerned. The predetermined break point via which the tamper-evident element is connected to the closure is preferably formed in the lid. For example, this entails one or more, preferably three or four material reductions, e.g. in the form of thinned-out portions or thin webs, which then widen out again toward the tamper-evident element. Thus, recesses for forming the predetermined break points are present in the lid top or in the lid. In the case of webs, the predetermined break point lies, depending on the design and shape of the web, either in the area of the tamper-evident element or of the lid or insert adjoining the web, or in the web itself. Often, the webs to be separated are themselves also referred to as predetermined break points.

In its area adjoining the predetermined break point, the tamper-evident element preferably has an oval shape in a plan view from above, in such a way that an axis that covers a straight line representing the longest extent within the oval does not intersect the outlet opening. The straight line is in particular an axis of symmetry of the oval. Thus, the tamper-evident element or the tamper-evident closure can in particular be arranged in a flat, tab-shaped area of a closure provided for gripping the lid, and it can have a longer extent in the circumferential direction than in a direction radial to a central longitudinal center axis of the closure. In this respect, the invention takes into account the fact that, precisely in the case of dense packaging forms on trays, areas such as grip tabs protrude only a short way beyond the circumference of an otherwise circular or cylindrical packaging container. The tamper-evident closure can, however, be made sufficiently large.

The tamper-evident element is further safeguarded against improper handling by the fact that, when viewed along a perpendicular line with respect to a central longitudinal center axis of the closure, it is covered, on the side facing away from the longitudinal center axis, by a part of the closure. Particularly preferably, the tamper-evident element is covered on all sides about a central longitudinal center axis, such that it cannot easily be removed from its position indicating originality.

A force applied for opening purposes is efficiently transferred to the tamper-evident element and the predetermined break points if the tamper-evident element is secured on a grip tab of the lid and, in particular, if the lid has no further attachment areas for gripping. An actuation or opening of the lid thus generally entails a breaking of the tamper-evident seal and therefore cannot remain concealed either intentionally or unintentionally.

The aforementioned object is likewise achieved by an article according to the preamble of claim 1, and in particular by an article as described above or below, which articles are each characterized in that the insert has at least one inner guide surface which, as viewed from a lower end in the direction toward an insert edge, comes closer to a central longitudinal center axis, in such a way that a container can be introduced from below into the insert and can be secured in the insert. The inner guide surface forms an insertion area through which a container, for example a container holding a child's toy, can be integrated into the closure at the filling factory even when the closure has already been lidded by the manufacturer. The closure can then be brought into engagement with the rest of the confectionery packaging. The closure according to the invention and a corresponding packaging are thus a benefit for children and confectionery suppliers.

The guide surface is preferably designed tapering conically upward and thus forms an upwardly tapering truncated cone. This permits clear and easier insertion of the container that is to be fitted. Jamming as a result of ridges or the like is substantially avoided.

In a closure according to the invention, it is thus advantageous if the latter has a container secured in the insert, which container is secured, for example, by latching onto corners or latching into corresponding recesses of the insert.

Advantageously, the container has at least one clamping means on its outside, which clamping means is preferably designed as a clamping web running in the direction of its longitudinal extent. Advantageously, the container has on its outside, and alternatively or in addition on its inside, a plurality of clamping elements distributed regularly along its circumferential direction. By the use of such clamping elements, preferably clamping webs, whose radial extents do not go beyond the outer circumference of the container, it is possible for a plurality of such containers to be fitted into one another like building blocks and clamped, such that, for example, a greater incentive to play is created for children. For example, a bottom of a container is located in the clamping position at half the height of the side wall, i.e. the containers do not slide into one another as far as the bottom when being stacked. In addition, such clamping means in the form of clamping webs can also serve as guide means for supporting the container in packaging.

A container secured in the insert is preferably provided, at its upper end, at least with one collar which protrudes over the insert edge and, in particular, bears against the latter. Upon opening of the lid, the container can therefore be easily removed upward.

In a further advantageous embodiment of the invention, the lid has a lid edge, the surface of which extends in parts, in a lid-down situation before a first use, parallel to the longitudinal extent of the tamper-evident element. The main longitudinal extent of the tamper-evident element is thus in the direction of the central longitudinal center axis of the closure, which results in less space being taken up.

According to the invention, the insert is provided, on the circumferential side, with at least one latching element which is designed to latch with at least one further part of the packaging. In this way, the production of the desired packagings for confectionery can be carried out more quickly. Such latching can, for example, be provided by a plurality of downwardly tapering latching cams which have upper edges and which fix a bead of the packaging container between an upper part of the insert and the edge.

Against the background of in particular small-volume spaces available for tamper-evident closures, it has proven advantageous if the tamper-evident closure is assigned an in particular oval opening or recess, the boundary of which forms the projection for securing the tamper-evident element.

Typically, lid and insert can be connected integrally to each other via a hinge designed as a film hinge. It is then advantageous if lid and insert each have an edge, and these edges can be fixed to each other via at least one securing means. The fixing of the lid thus also takes place independently of the tamper-evident element, and the lid is effectively prevented from being able to be opened without damaging the original seal.

One or more such securing means can be designed in particular as beads which push past each other upon closing or opening of the lid and thus also function as latching elements.

To make it easier to remove a container, it has proven advantageous if the insert, toward its edge, has a portion that serves to widen the free internal cross section, for example a portion in the form of a peripheral shoulder. The insert edge can merge directly into such a shoulder.

The object is likewise achieved by a packaging for foodstuffs which is characterized by a closure of the kind described above or below. In particular, this can be a packaging for small chocolate goods.

Figure 2:
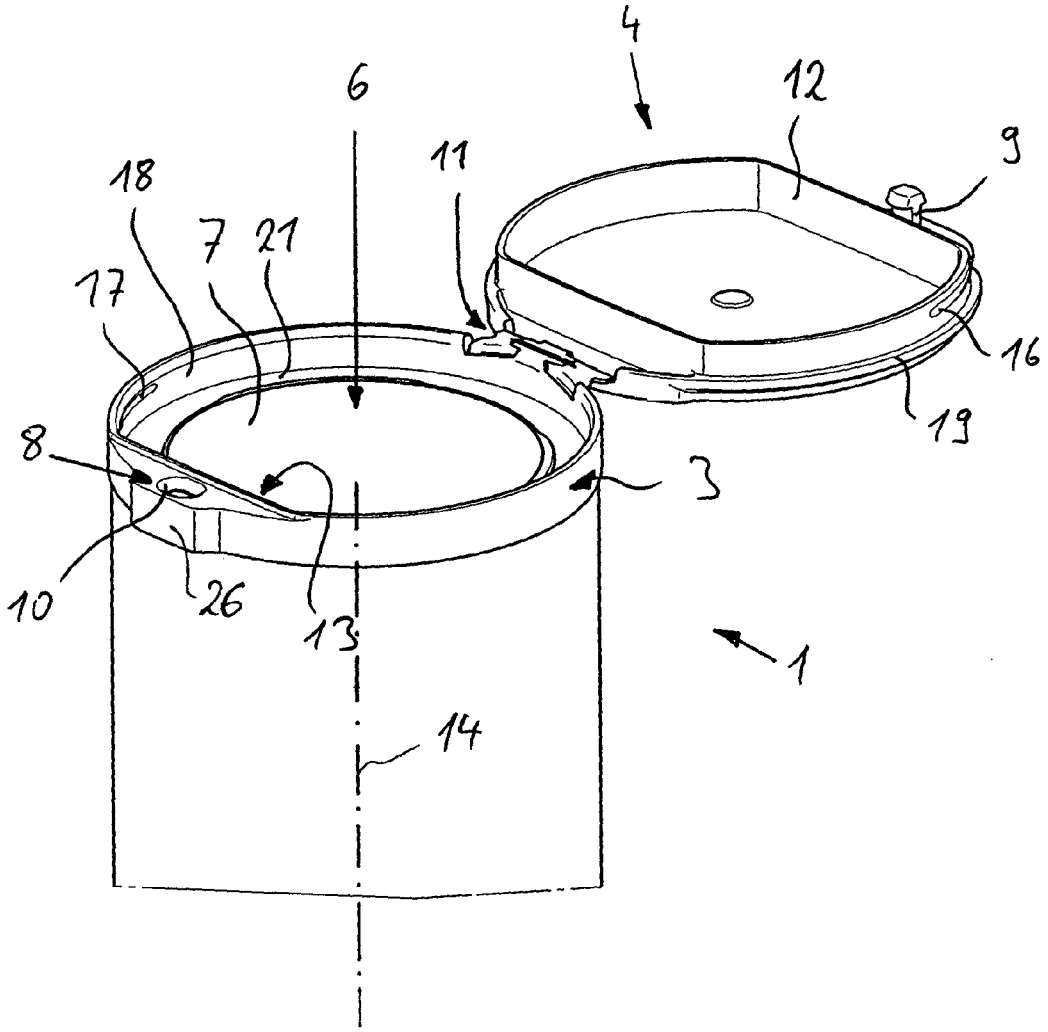
Figure 3A:
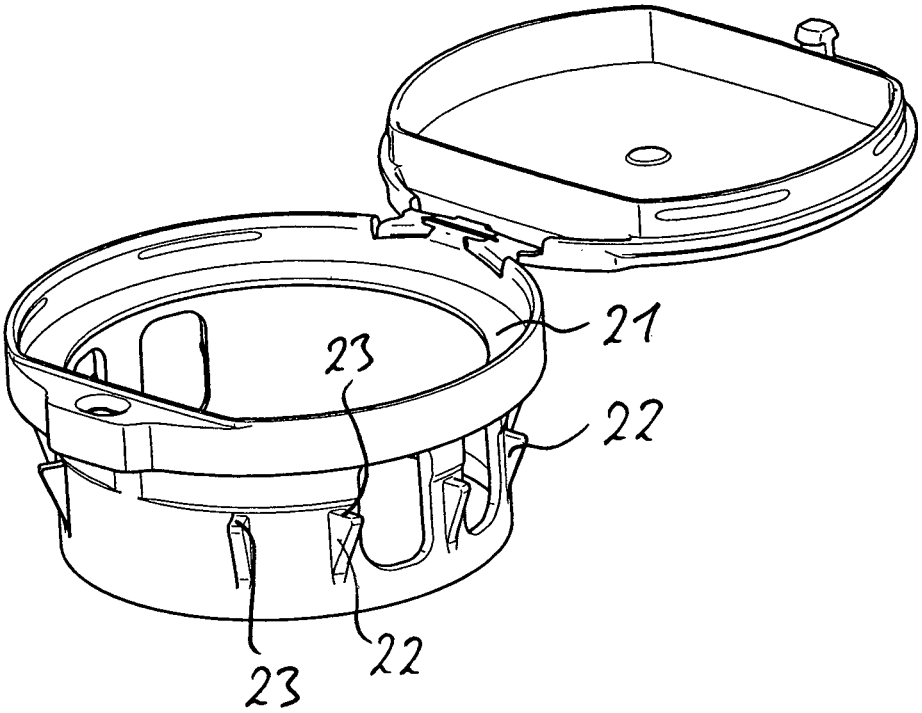
Figure 3B:
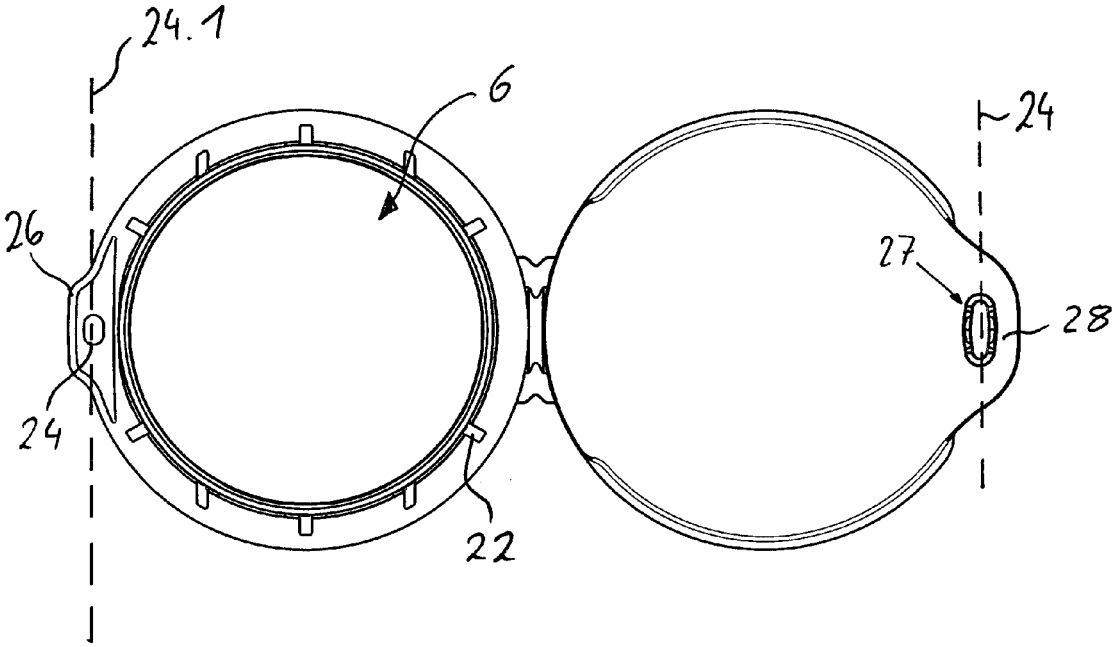
Figure 4:
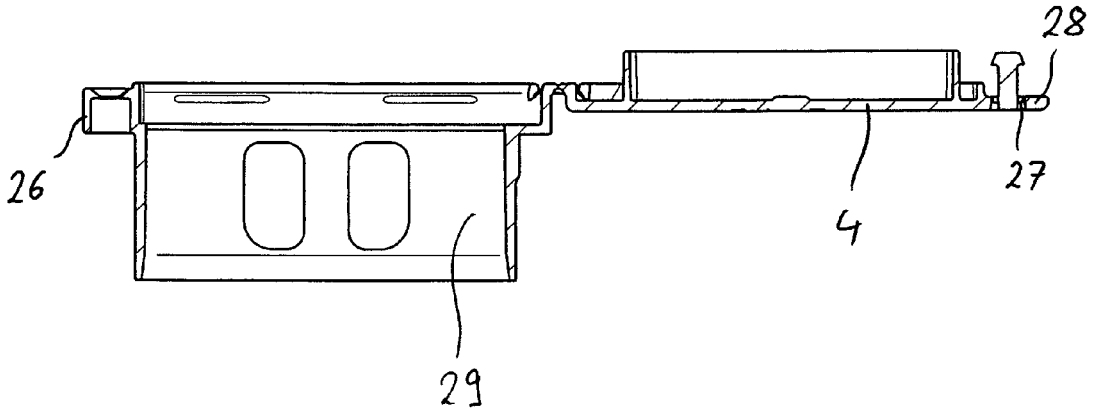
Figure 5:
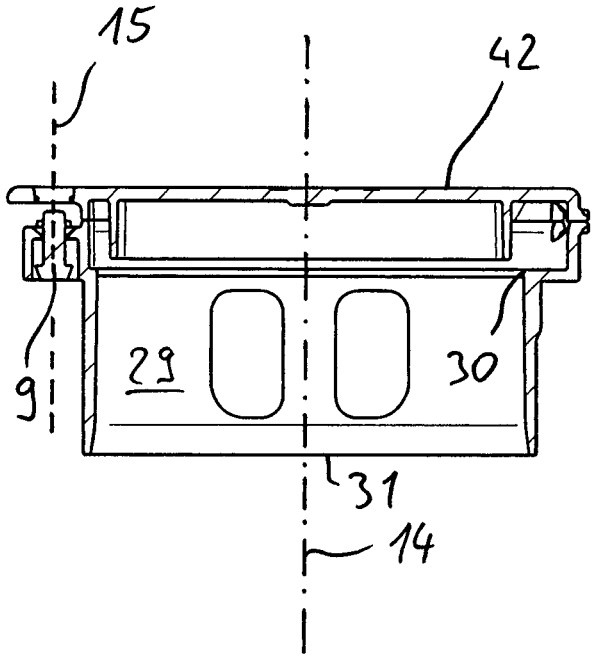
Figure 6:
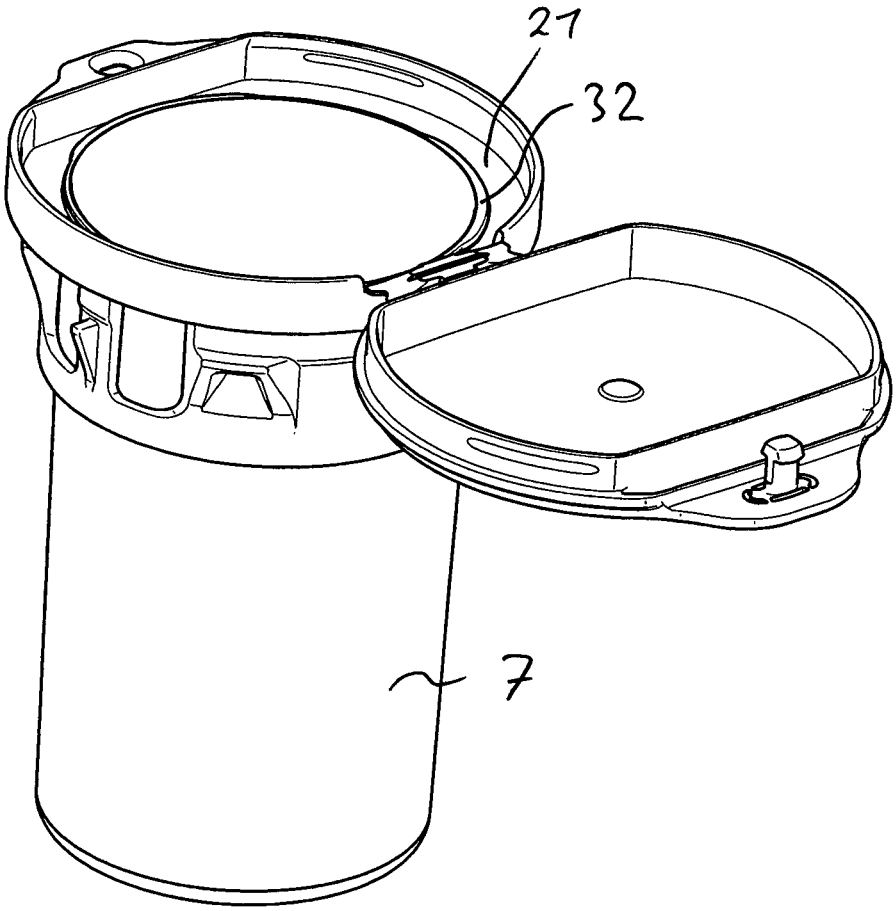
Figure 7:
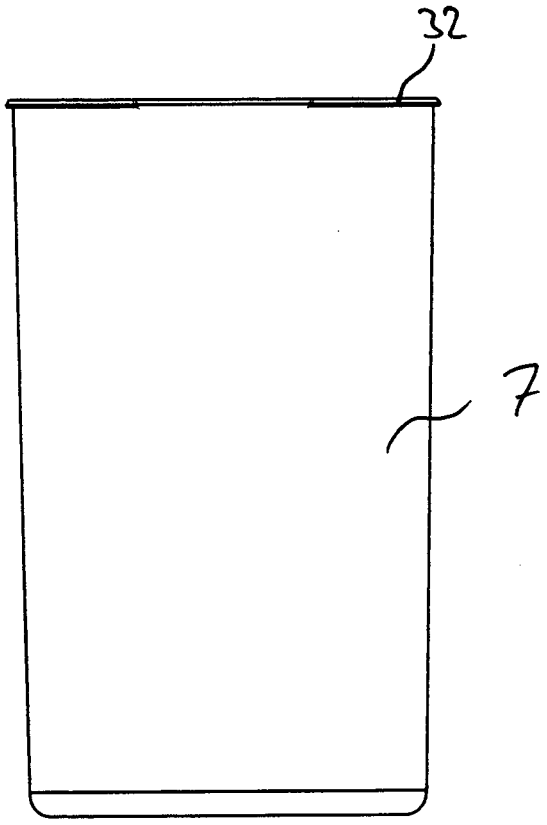
Figure 8:
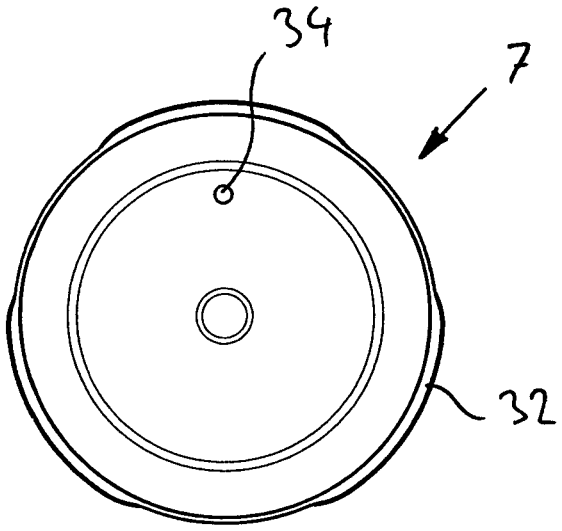
Figure 9:
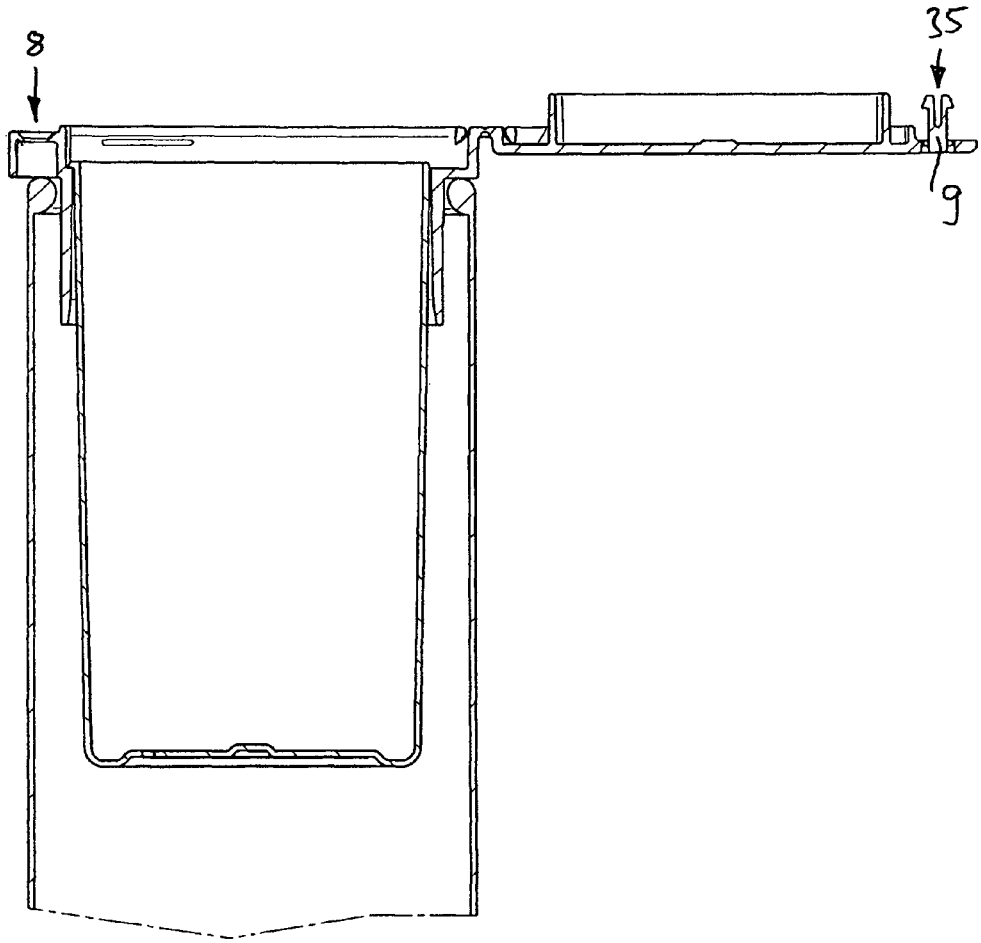
Figure 10:
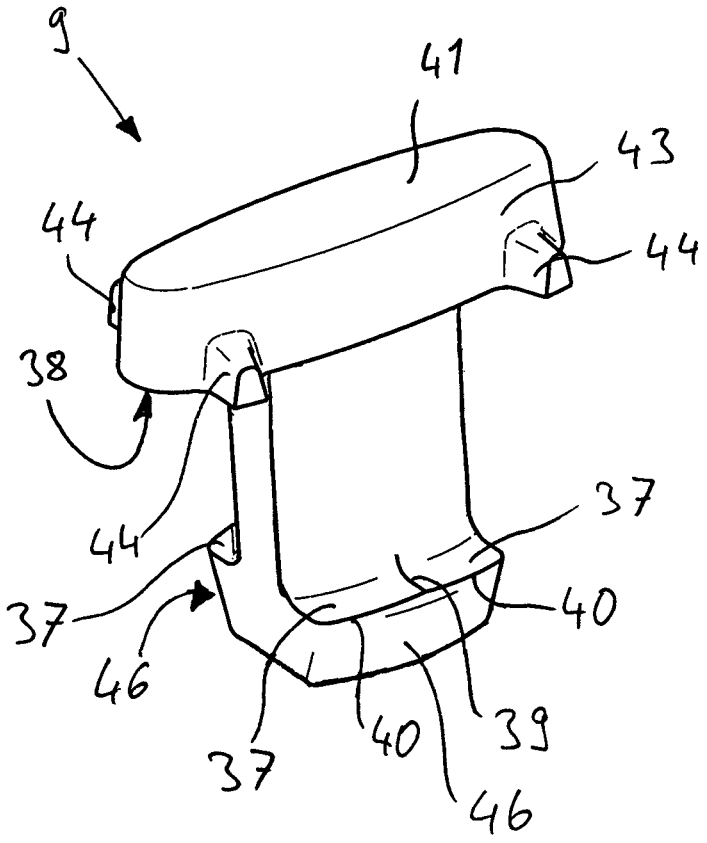
Figure 11:
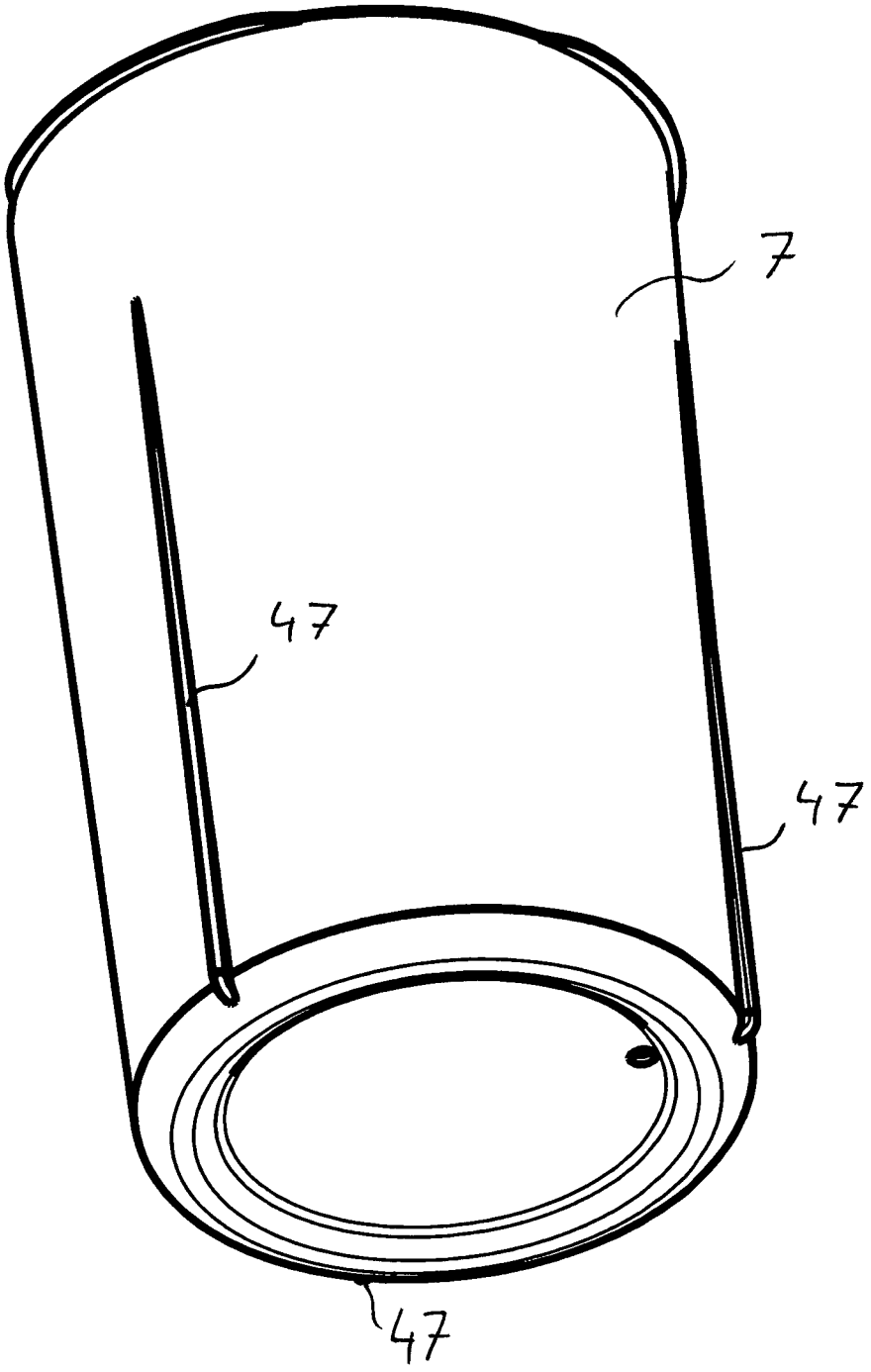

Further advantages and details of the invention are set forth in the following description of the schematic figures, in which:

FIG. 1 shows an article according to the invention in a partial view,

FIG. 2 shows the article according to the invention from FIG. 1 in a lid-up position, FIG. 3*a* shows a further article according to the invention, FIG. 3*b* shows the article from FIG. 3*a* in a bottom view, FIG. 4 shows the article from FIG. 3*a* in a cross section, FIG. 5 shows the article from FIG. 4 with the tamper-evident seal broken open, FIG. 6 shows a further article according to the invention, FIG. 7 shows a side view of the container from FIG. 6, FIG. 8 shows the article from FIG. 7 in a plan view, FIG. 9 shows a further article according to the invention, FIG. 10 shows a tamper-evident element of the article from FIG. 1, FIG. 11 shows a part of a further article according to the invention.

Parts having an identical or similar effect are, where appropriate, provided with identical reference numbers. Individual technical features taken from the figures described below can, together with the above-described illustrative embodiments, lead to refinements according to the invention.

FIG. 1 shows substantially cylindrical packaging 1 for foodstuffs, with a closure 2 which closes the open end of a hollow cylindrical part 5 of the packaging 1. The closure 2 comprises an insert 3 secured on the for example cardboard part 5 of the packaging, and a lid 4 connected to the insert 3 in an articulated manner and closing an upper discharging opening of the insert.

The insert 3 has a central discharging opening 6 into which, in this case, a container 7 is fitted (FIG. 2).

The lid 4 is connected to the insert 3 in FIG. 1 via a tamper-evident closure. The tamper-evident closure includes the opening 8, visible in FIG. 2, and a tamper-evident element 9. In this illustrative embodiment, this tamper-evident element is connected to the lid via several predetermined break points. The predetermined break points are formed by thin webs, which hold the tamper-evident element on the lid.

The lid 4 is secured integrally on the insert 3 by a film hinge 11.

It will already be seen from FIG. 2 that the tamper-evident element 9, designed as a tamper-evident pin, is arranged toward the side of a circumferential lid edge 12 of the closure and likewise toward the side of an insert edge 13. This already has the effect that the tamper-evident pin is offset with respect to the discharging opening 6. Moreover, in the lid-down position, a central longitudinal center axis 15 of the tamper-evident element runs parallel to a central longitudinal center axis 14 of the closure 2 (cf. FIG. 5).

As can be seen from the subsequent figures, in particular from FIG. 10, the tamper-evident element is provided at least with one abutment at each of its opposite ends, between which abutments the tamper-evident element 9 is held on a projection 10 of the insert after the tamper-evident closure has been undone or broken and the originality destroyed. This projection 10, which at the same time forms a tapering run-in surface for the tamper-evident element for better lidding, is formed by a border enclosing the oval recess of the tamper-evident closure.

The lid edge 12 bears on the inside of an insert edge 18 via bead-like securing means 16, which hook onto likewise bead-shaped securing means 17 of the insert edge 18. Depending on the illustrative embodiment, these beads extend over only a part of the respective edge, or they can also extend completely along the edge. The longer the beads, the better the lid and insert hold together. By means of a small peripheral lid collar 19, it is possible, at least in parts, to prevent the closure being levered open laterally between film hinge 11 and tamper-evident closure.

In order to make the discharging opening suitably wide, for example corresponding to the free internal diameter of the packaging part 5, the tamper-evident closure and the elements serving to secure the lid are, in relation to a central longitudinal center axis 14, offset outwardly with respect to the central longitudinal center axis 14 via a collar-shaped portion 21 serving to widen the free internal cross section of the insert 2.

FIGS. 3*a* and 3*b* show a large number of latching elements 22 via which a peripheral bead of the packaging 1 can be secured between the upper edges 23 and the underside of the collar-shaped portion 21.

An edge 24 defining the opening or recess 8 has an oval shape and delimits the projection for securing the tamper-evident element. Both the opening and also an end of the tamper-evident element are oval-shaped, in order to configure a tamper-evident closure that is sufficiently large but at the same time increases as little as possible the radial extent of the closure in relation to the longitudinal center axis 14. Accordingly, in the area adjoining the predetermined break point, the shape of the tamper-evident element is oval in a plan view from above, in such a way that an axis that covers a straight line 24 representing the longest extent within the oval does not intersect the outlet opening. In the lid-down position, the axis 24 is congruent with the axis 24.1 shown in FIG. 3*b*. Both axes are located to the side of the discharging opening.

In FIGS. 3*a* and 3*b*, and also in FIGS. 4 and 5, the tamper-evident element, as viewed along a perpendicular line with respect to a central longitudinal center axis of the closure, is covered, on its side facing away from the longitudinal center axis, by a part, in particular a wall 26, of the closure. This wall 26 merges into the further edge 18 of the insert and prevents children from playing about with and accidentally swallowing the tamper-evident element 9 after the lid is opened. The childproofing of the closure according to the invention is improved by the tamper-evident pin being covered along the circumference thereof about its longitudinal axis 14.1.

According to FIGS. 3*b* and 4, the tamper-evident element is advantageously secured on a grip tab 28 of the lid 4 via predetermined break points 27. A force applied there leads immediately to the tearing of the tamper-evident seal, which is then accordingly visible.

After the lid has been opened and the tamper-evident seal broken, the tamper-evident element 9 is held via mutually facing edges or sides at its two ends, specifically between these, and on the projection 10 of the insert (FIG. 5).

According to FIGS. 4 and 5, an insert according to the invention has an inner guide surface 29 which, as viewed from a lower end in the direction toward an insert edge 30, comes closer to the central longitudinal center axis 14, in such a way that a container introduced from below can be secured in the insert, specifically engaging over the edge 30. Thus, the closure according to the invention can already be lidded by the manufacturer, while the container, for example with a toy, can be added by the filler and inserted from underneath. Accordingly, the distance of the inner guide surface 29, at the lower edge 31 thereof, from the central longitudinal center axis 14 is greater than the distance of the central longitudinal center axis 14 from the edge 30.

In particular, the guide surface is configured as a conically upwardly tapering guide surface, which permits simple insertion of a container that is to be secured in the insert.

In the illustrative embodiment according to the invention in FIG. 6, such a container 7 is shown which, at its upper edge, has a protruding collar in the form of collar portions 32 which protrude over the insert edge, and it is thereby supported on the collar 21 of the insert.

The container, according to 7, can be a substantially closed container 7 which only has a removal opening at the top and, for the purpose of better air pressure equalization with the receiving space of the packaging below it, comprises an opening 34. The container 7 can be better removed via the opening 34. However, it can also be a latticed container.

In the further illustrative embodiment according to FIG. 9, which is distinguished in particular by a differently configured tamper-evident pin 9, a container is likewise provided which, in the situation shown, can likewise be removed upward from the packaging. For the purpose of improved insertion through the associated opening 8 of the tamper-evident closure, the tamper-evident pin has a gap 35, by means of which the cross section of the tamper-evident pin can taper upon insertion into the opening 8.

The tamper-evident element 9 of the illustrative embodiments in FIGS. 1 to 8 is shown in more detail in FIG. 10. Surfaces 37 and 38 facing toward each other are present at the ends of a rod-shaped middle part 36. Whereas at one end the surface 38 and its boundary form an abutment, this is formed on the opposite side by an edge 39. Likewise, the edges 40 or, in another surface profile, the surface 37 itself can serve as abutment.

In the unopened state, a top 41 of the tamper-evident element extends substantially at the same height as a lid top 42 (cf. FIG. 5). Webs 44 providing predetermined break points are formed integrally on an edge 43, adjoining the top, of the end-side thickening of the tamper-evident element 9. In the original state, the webs 44 are likewise formed integrally on the lid. Overall, the upper thickened end in FIG. 10 is oval in horizontal section, as has been described above, whereas the lower end has, for the purpose of better lidding, oblique guide surfaces 46 on opposite sides.

FIG. 11 shows a container of a further closure according to the invention. In addition to the features of the container 7 from FIG. 7, the alternative embodiment of a container 7 shown here has clamping means 47, which are in the form of three clamping ridges distributed uniformly about the outer circumference of the container. By means of these clamping ridges, several containers 7 can be stacked on top of one another, without the containers sliding completely into one another. Instead, the clamping ridges ensure that one container is clamped in a further container and, as a result, the containers can be stacked on top of one another like building blocks. As an alternative to a design with clamping ridges, the clamping means can of course also have another configuration. However, it is important that, despite the widening of the cross section, the otherwise conically downwardly tapering container is clamped onto a further container such that the containers can be used, as described above, for playing. Alternatively, bearing shoulders can also be formed on which a further container comes into contact, e.g. with its edge, for stacking purposes.

The invention claimed is:

1. A closure comprising:

an insert comprising a central discharging opening and configured to be secured to a part on a packaging;

a lid connected in an articulated manner to the insert to close the discharging opening from the top; and a tamper-evident closure that connects the lid to the insert, the tamper-evident closure having a tamper-evident element which is connected to a grip tab of the lid via at least one predetermined break point and, in a lid-down position in which the lid closes the discharging opening, is arranged toward a side of the closure and therefore offset with respect to the discharging opening, the tamper-evident element is a pin comprising a first abutment at a bottom end of the pin and a second abutment at a top end of the pin, the tamper-evident element is held between the first and second abutments on a projection of the insert after the tamper-evident closure has been undone, the top end of the pin comprising the at least one predetermined break point.

2. The closure of claim 1, wherein the at least one predetermined break point is integrated into the lid so that the at least one predetermined break point can be seen from above the closure in a plan view.

3. The closure of claim 1, wherein at an area adjoining the at least one predetermined break point, the tamper-evident element has an oval shape in a plan view from above the closure, so that an axis that covers a straight line representing the longest extent within the oval does not intersect the discharging opening.

4. The closure of claim 1, wherein, as viewed along a perpendicular line with respect to a central longitudinal center axis of the closure, the tamper-evident element is covered, on the side facing away from the longitudinal center axis, by a part of the closure.

5. The closure of claim 1, wherein the lid has a circumferential lid edge received by an interior of the insert when the lid is closed, the tamper-evident member extends from the grip tab, and the tamper-evident member and the circumferential lid edge terminate in the same plane.

6. The closure of claim 1, wherein the insert has at least one inner guide surface which, as viewed from a lower end in a direction toward an insert edge, is closer to a central longitudinal center axis, so that a container introduced from below can be secured in the insert.

7. The closure of claim 6, wherein the at least one inner guide surface is designed to taper conically upward.

8. The closure of claim 6, comprising a container secured in the insert.

9. The closure of claim 8, wherein the container has at least one clamping member located on an outside of the container.

10. The closure of claim 1, comprising a container secured in the insert that has, at an upper end of the container, at least one collar which protrudes over an insert edge.

11. The closure of claim 1, wherein the lid has a lid edge, the surface of which extends in part, in the lid-down position before a first use, parallel to a longitudinal extent of the tamper-evident element.

12. The closure of claim 1, wherein on a circumferential side, the insert has at least one latching element which is designed to latch with at least one further part of the packaging.

13. The closure of claim 12, wherein the tamper-evident closure has an opening or recess, the boundary of which forms the projection for securing the tamper-evident element.

14. The closure of claim 1, wherein the lid and the insert each form an edge, which edges can be fixed to each other via at least one securing member.

15. The closure of claim 14 comprising a plurality of securing members that are configured as beads.

16. The closure of claim 1, wherein, toward an edge of the insert, the insert has a portion that serves to widen the free internal cross section.

17. The closure of claim 1, wherein the lid comprises a central portion vertically aligned with the discharging opening when the lid is in the lid-down position, and a top surface of the central portion is coplanar with a top surface of the grip tab.

18. The closure of claim 1, wherein the at least one predetermined break point connecting the tamper-evident element to the grip tab comprises a first predetermined break point and a second predetermined break point, the first predetermined break point positioned on a side of the top end of the pin facing a first direction, the second predetermined break point positioned on an opposite side of the top end of the pin facing a second direction opposite to the first direction.

19. The closure of claim 14 wherein the securing members extend from a cylindrical portion of the insert, the insert comprises a collar-shaped portion that extends outward from the cylindrical portion, and a peripheral bead of the packaging is secured between a top edge of the securing members and an underside of the collar-shaped portion.

20. A packaging for foodstuffs comprising:

a closure comprising an insert comprising a central discharging opening and secured to a part on the packaging, the closure comprising a lid connected in an articulated manner to the insert, for closing the discharging opening from the top, the closure comprising a tamper-evident closure that connects the lid to the insert, the tamper-evident closure having a tamper-evident element which is connected to the lid or the insert via at least one predetermined break point and, in a lid-down position in which the lid closes the discharging opening, is arranged toward a side of the closure and therefore offset with respect to the discharging opening, the tamper-evident element is a pin comprising a first abutment at a bottom end of the pin and a second abutment at a top end of the pin, the tamper-evident element is held between the first and second abutments on a projection of the insert after the tamper-evident closure has been undone, the top end of the pin comprising the at least one predetermined break point.

* * * * *